United States Patent [19]

Conti

[11] 4,122,787

[45] Oct. 31, 1978

[54] SEWING METHOD AND MACHINE

[75] Inventor: Roberto Conti, Milan, Italy

[73] Assignee: Complett S.p.A., Milan, Italy

[21] Appl. No.: 710,138

[22] Filed: Jul. 30, 1976

[30] Foreign Application Priority Data

Sep. 5, 1975 [IT] Italy ..... 26954 A/75

[51] Int. Cl.[2] ..... D05B 23/00

[52] U.S. Cl. ..... 112/170; 112/262

[58] Field of Search ..... 112/170, 172, 171, 94, 112/262

[56] References Cited

U.S. PATENT DOCUMENTS

| | | | |
|---|---|---|---|
| 18,522 | 10/1857 | Roper | 112/170 |
| 2,622,551 | 12/1952 | Gerber | 112/94 |
| 3,207,107 | 9/1965 | Castany Ferré | 112/170 |
| 3,238,903 | 3/1966 | Pav | 112/170 X |

*Primary Examiner*—H. Hampton Hunter
*Attorney, Agent, or Firm*—Karl F. Ross

[57] ABSTRACT

Stitches on alternate sides of a fabric workpiece are produced by the operation of a sewing machine whose needle has a laterally open eye formed with a double-hook contour so that a thread is carried downwardly through the fabric by the eye during a first phase of the initial reciprocation cycle of the needle, the needle is withdrawn upwardly through the fabric without thread during the second phase of this cycle, the needle passes downwardly through the fabric without a thread during the first phase of the next cycle and carries the thread upwardly through the fabric during the second phase of this latter cycle. Below the fabric is a rotary disk having a hook which engages the thread as it passes downwardly through the fabric to draw an entire free thread length out and enable same to be positioned by a thread taker for engagement in the eye of the needle during the upstroke of its second cycle. Above the fabric is a swingable hook which is provided to guide the free thread length upwardly through the fabric following the upstroke of the second cycle and prior to the next downstroke by which the process is repeated while holding the thread length along the needle.

7 Claims, 19 Drawing Figures

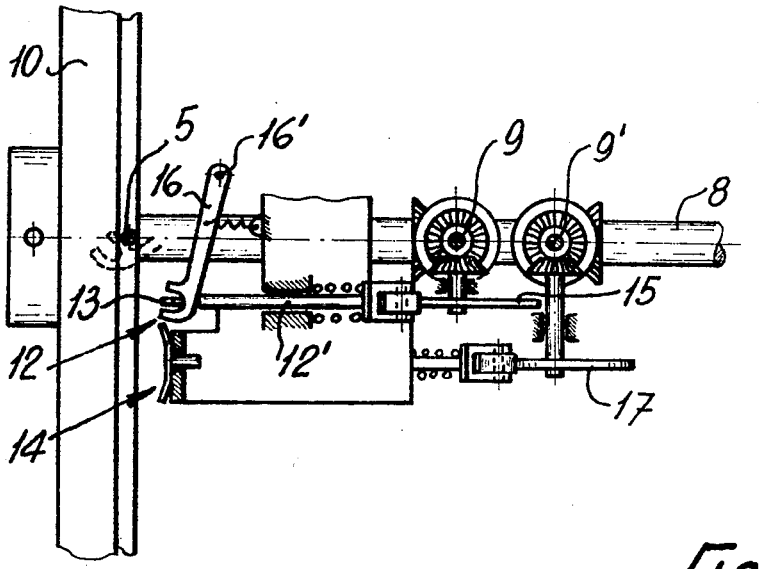
FIG. 6
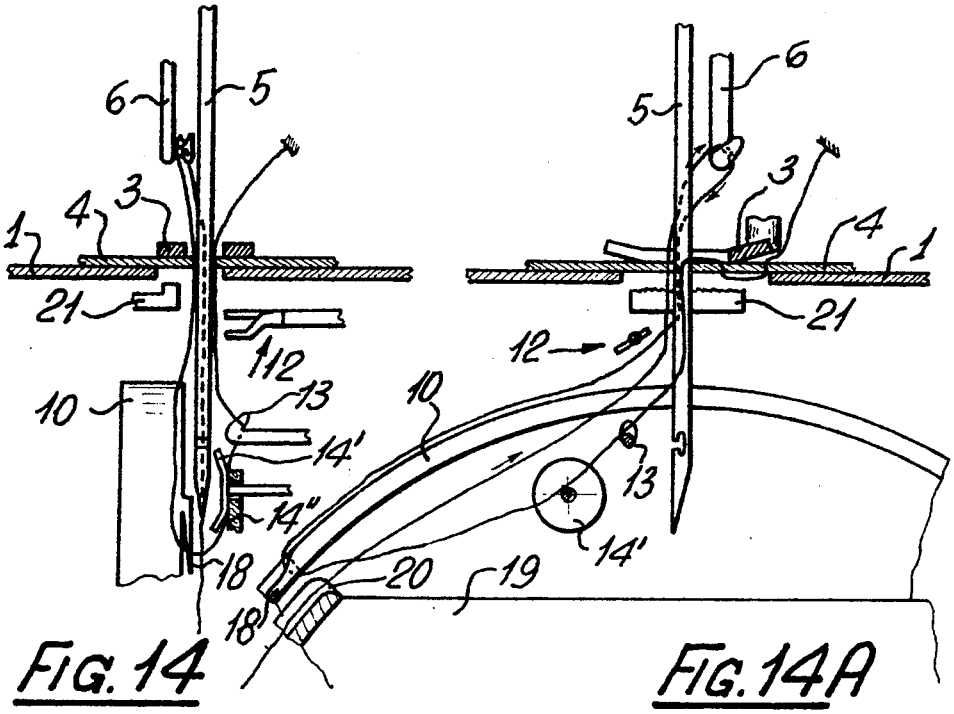
FIG. 14
FIG. 14A

SEWING METHOD AND MACHINE

This invention relates to a method of forming saddle and alternately short and long stitches (a feature of hand sewing). The invention also deals with a sewing machine fitted with a special needle, for practicing this method.

As is well known, saddle and short-long stitches are formed by a single sewing thread of predetermined length (i.e. a so-called "needleful") which is sewn through the edges of fabric workpieces, whereby it shows alternatively of the obverse side and on the reverse side of the fabric which is being sewn.

Such stitches, which can be made manually, are usually provided for ornamental purposes in ready-to-wear clothing, in particular on lapels, pockets etc., as well as in the making-up of trousers, handbags, gloves and similar articles.

However, manual operations represent a hindrance in the industrial production of ready-to-wear clothing by present manufacturing techniques.

The main object of this invention is to provide for the mechanical production of these particular sewing stitches, having ornamental features, for meeting the requirements of industrial production of ready-to-wear clothing.

The method for mechanically producing saddle and short-long stitches (i.e. stitches on alternate sides of a fabric) according to the inventions, provides that the thread, in the first phase of up-and-down motion of needle, is carried by a needle below the fabric and released therebetween. The whole free length of thread, i.e. the needleful is then transferred and retained for the formation of a lower stitch while the fabric is advanced. In the second phase of the cycle, the same thread length is again engaged by the needle, carried above the fabric and retained thereabove for the formation of an upper stitch, while the fabric is again advanced.

The sewing machine according to this invention has an open-eye needle to allow for the disengagement and the re-engagement of the thread by the needle. The machine also includes thread-engaging devices, located below the fabric, for disengaging the free thread length from the needle, drawing the entire length below the fabric, and retaining the free thread length below the fabric while the fabric is fed. A thread taker is also located below the fabric for re-engaging the thread with the needle while a swinging hook is located above the fabric, for guiding the thread and holding it against the needle for engagement in the open eye, while the fabric is being fed. All of these elements are advantageously controlled by cams, driven by the main driving shaft of the sewing machine to bring them from their operative positions to their inoperative positions and vice-versa in the required sequence and in synchronism with the operating phases of the sewing machine.

The laterally open eye of the needle has a double-hook inner contour to allow for the engagement and transport of thread in both directions of the needle stroke although the needle has a non-symmetrical point to prevent the fabric from entering into the open eye in both directions of the needle stroke therethrough.

The thread-engaging devices located below the fabric include a disk revolving about a horizontal axis slightly shifted rearwardly with respect to the needle stroke plane, and which is rotated through an entire revolution (360°) during each needle-operating stroke. Fitted to the outer edge of this disk is a hook which engages one side of the loop formed by the thread carried by the needle is engaged each second operating phase, for drawing it downwardly the free thread length in the course of disk rotary motion. This disk cooperates with a pick-up hook and a thread tension device, located in front of the disk, by which the other loop side is engaged, and to which a reciprocating motion in a horizontal plane is imparted each two needle operating phases.

The thread-taking member, to which a reciprocating motion in a horizontal plane is also imparted each two operating cycles, is engaged with a fork-shaped member, to which a swinging motion is imparted for engagement of the thread and to bring it toward the open eye of the needle, thus engaging it therewith, during the needle upstroke.

A stroke each two operating cycles is performed by the upper swinging hook.

In the drawing:

FIG. 6 is a plan view of a detail, as seen on the line VI—VI in FIG. 4.

Figure 10:
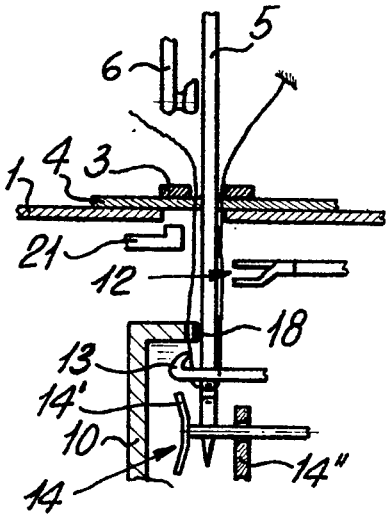
Figure 10A:
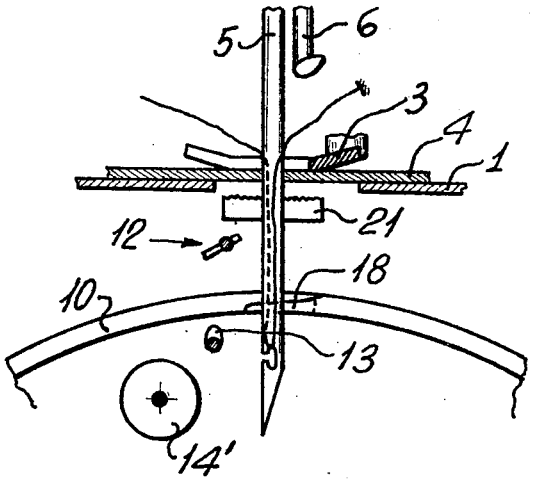

FIGS. 10 and 14 inclusive diagrammatically show, in front and side views, respectively, the positions of sewing members in the different phases of a cycle, each "cycle" being the downstroke and upstroke of the needle, and of fabric feeding In FIGS. 10–14:

FIGS. 10 and 10A show the downstroke of needle in the first phase and at the start of sewing operation.

Figure 11:
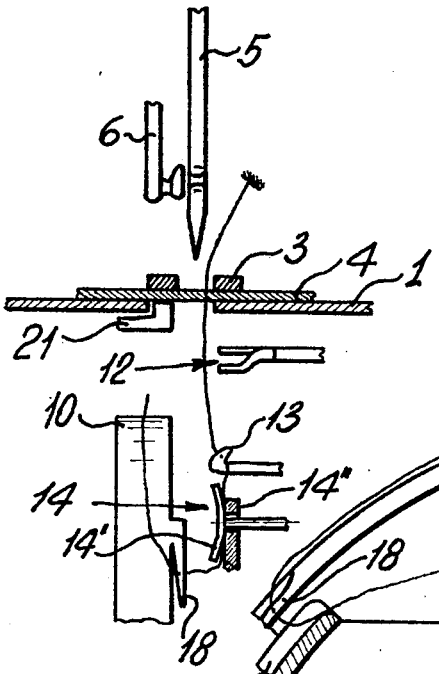
Figure 11A:
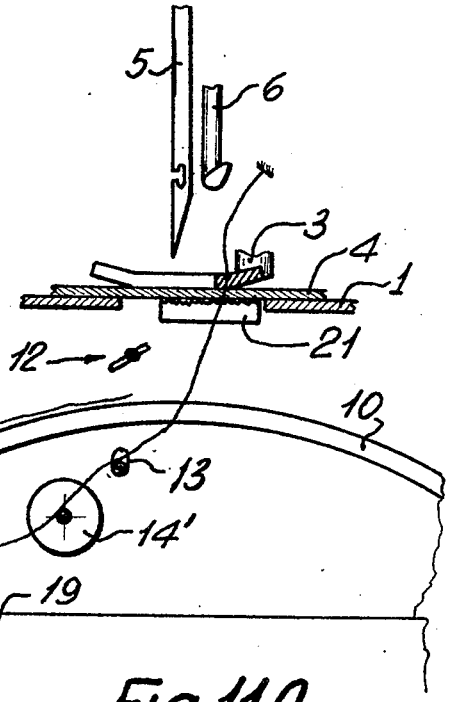

FIGS. 11 and 11A show the needle upstroke in the second phase of the first cycle.

Figure 12:
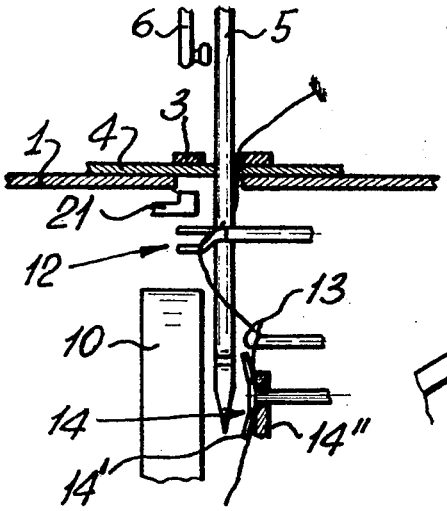
Figure 12A:
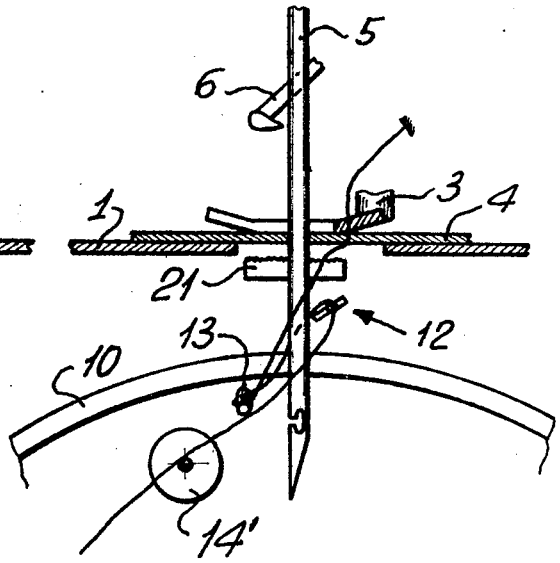

FIGS. 12 and 12A show the needle downstroke in the first phase of the second cycle.

Figure 13:
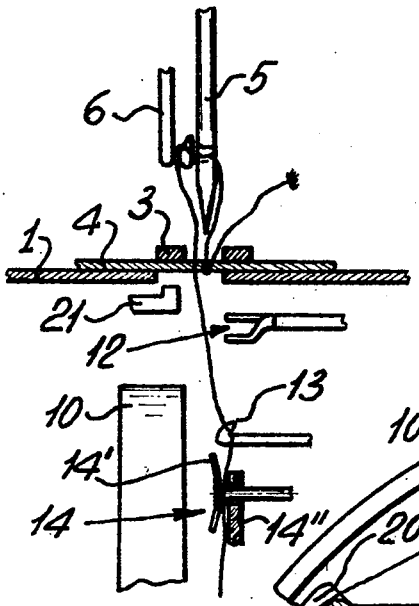
Figure 13A:
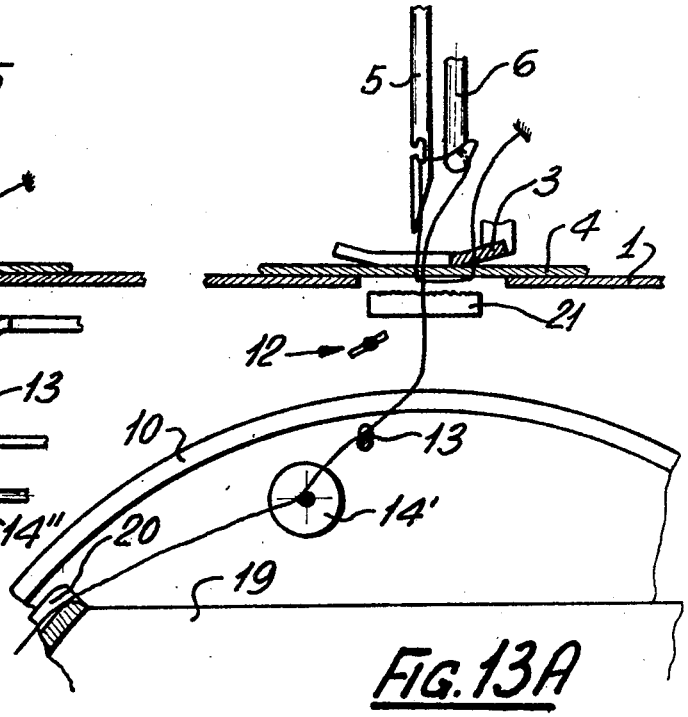

FIGS. 13 and 13A show the needle upstroke in the second phase of the second cycle.

FIGS. 14 and 14A show the needle downstroke in the third cycle.

Figure 1:
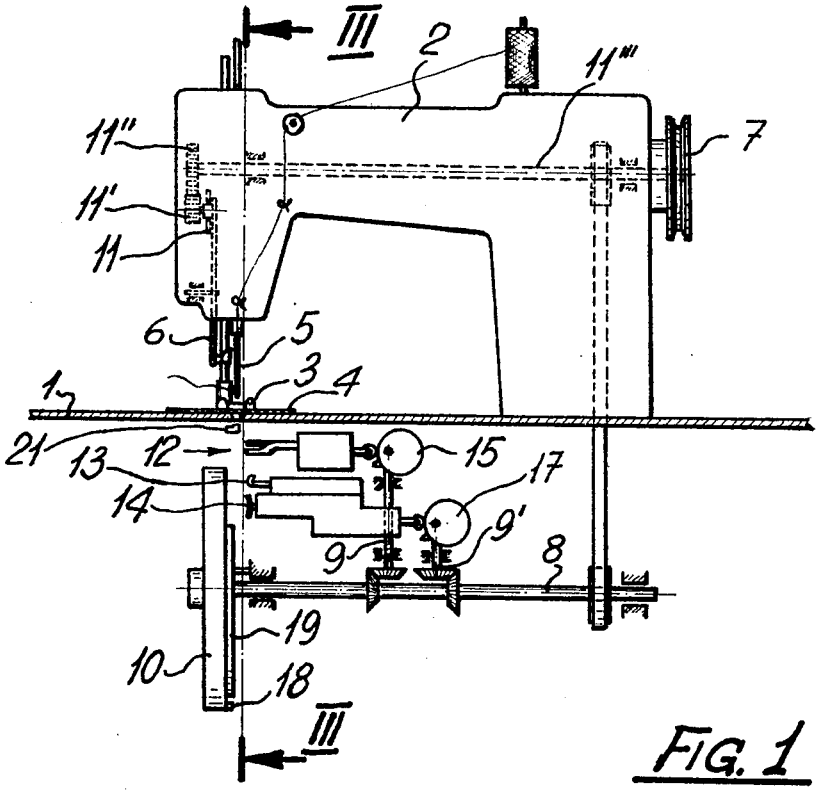
FIG. 1 is a diagrammatic side view of a sewing machine according to the invention.
Figure 2:
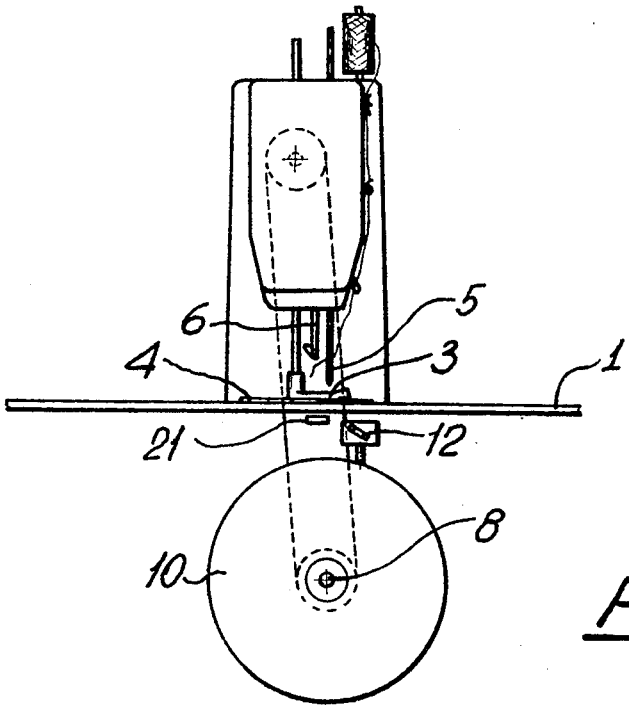
FIG. 2 is a diagrammatic front view as seen from the left in FIG. 1.

Referring now to FIGS. 1 and 2, wherein the standard components of a conventional sewing machine have been omitted or not particularly shown, a stitch plate 1 underlies the sewing machine arm 2 which has a presser foot 3 for the fabric or cloth 4 to be sewn, the special needle 5 and a swinging hook 6.

Fitted below the stitch plate 1 are the devices designed to cooperate with the needle 5 for the mechanical formation of saddle and short-long stitches, and which are driven by the main transmission 7, through the shafts 8, 9, 9'; keyed on the shaft 8 is the disk 10, which is slightly offset rearwardly with respect to the needle stroke plane. The cams 15 and 17, by which the thread taker 12 and the thread tension 14 are respectively controlled, are driven by the shafts 9 and 9'.

Figure 3:
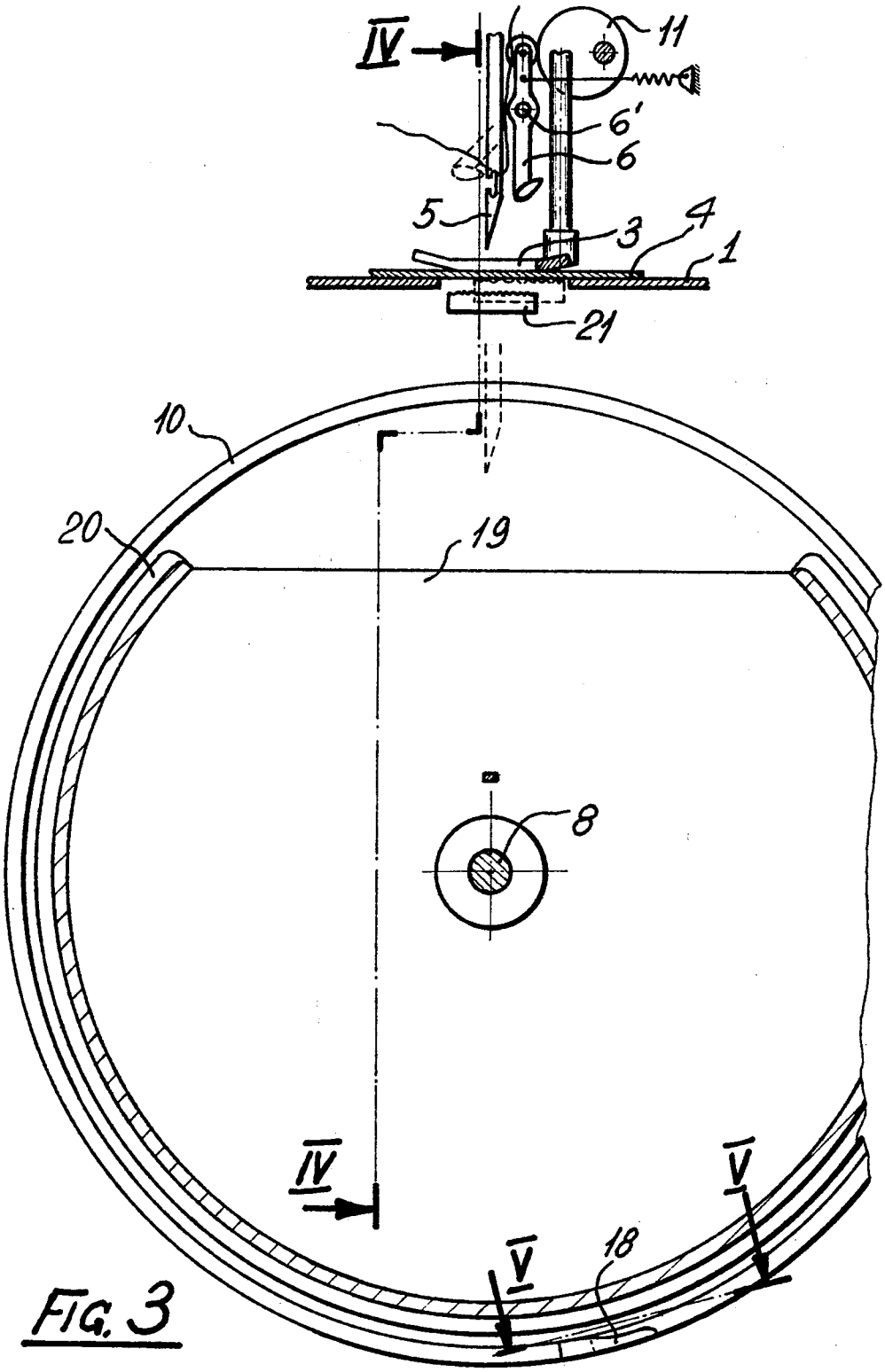
FIG. 3 is an enlarged cross-section taken along the line III—III of FIG. 1.
Figures 4, 5, 7, 8, 9:
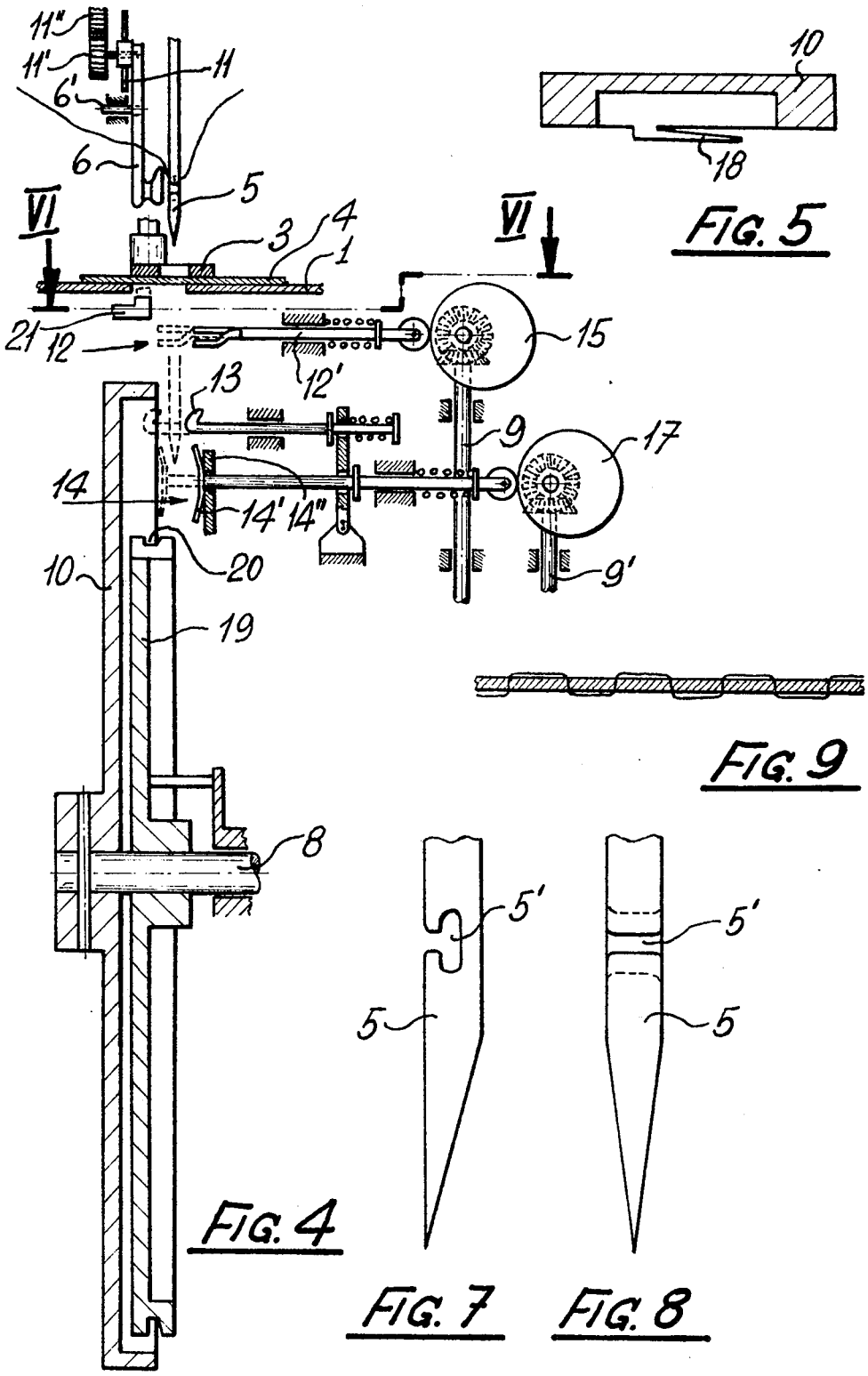
FIG. 4 is a cross-section taken along the line IV—IV of FIG. 3.
FIG. 5 is a cross-section of a detail taken along the line V—V in FIG. 3.
FIGS. 7 and 8 are enlarged front and side detail views, respectively of the sewing needle.
FIG. 9 shows the saddle and short-long stitch formation.

As can be seen from FIGS. 3 and 4, the swinging hook 6 is disposed laterally of the needles and is set back with respect thereto. The hook 6 is pivoted at 6' to swing, under the action of cam 11, across the plane of the needle between the two end positions shown in solid lines and with dash lines, respectively, in FIGS. 3.

The cam 11 is driven, through the gears 11' and 11'', by the shaft 11'' which is connected with the main transmission 7 (see FIG. 1.

Fitted below the stitch plate and near the downstroke travel of needle 5, are a thread taker 12, a hook 13 and a thread-device 14, all opposite the face of disk 10.

The thread taker 12 consists — as can also be seen from the detail of FIG. 6 — of a rod 12', slidingly fitted on a horizontal carrier, and reciprocated by the cam 15, which is in turn controlled by the shaft 9, through suitable connections.

The fork-shaped member 16, pivoted at 16', is swung about the needle 5, by the rod 12'.

The thread taker 12 engages the sewing thread and brings it, in the course of given operative steps, around the needle 5, and into the open eye thereof, in order to engage the same thread with the needle.

The hook 13 is slidingly reciprocated in a horizontal plane, and is kinematically connected with the thread tension member 14, which is also slidingly reciprocated on a horizontal plane by the cam 17, that is, in turn, controlled by the shaft 9', through suitable connections and transmissions (see FIG. 4).

Hook 13 engages sewing thread below the fabric; it operates in concomitance with the thread-tension member 14 by which the sewing thread can be locked, by pressing it by its plate 14' against a stationary stop 14''.

Secured to the edge of disk 10 is a hook 18, as shown in detail in FIG. 5, by which the thread is engaged below the fabric, and is recovered by the rotation of same disk 10.

Coaxially fitted to disk 10 is a stationary disk 19, formed with a circumferential groove 20 into which the thread recovered by the revolving disk 10, is laid.

A feed dog 21 feed the fabric during stitching and is located directly below the throat plate 1.

As shown in FIGS. 7 and 8, the needle 5 is shaped with a nonsymmetrical point, and with an open eye 5', having a double hook shaped inner contour.

The transmission ratios are established in such a manner as to cause the intervention of sewing components in the required sequence.

In particular, when considering as one "cycle" both strokes of the needle and the feeding of fabric:

The swinging hook 6 is swung each second cycle.

The thread taker 12 is operated each second cycle.

The hook 13 is swung each second cycle, in alternation with the strokes of thread taker 12.

The thread tension member 14 is operated each second cycle, concurrently with the motion of hook 13, and is kept inoperative while said hook 13 is moved for the recovery of sewing thread.

A hole revolution (by 360°) is performed at each cycle by the disk 10, while the sewing thread is engaged by the hook 18 each second cycle.

The machine operates as follows:

The sewing thread of standard type, usually wound on spools, is passed from the thread stand, through a tension disk, to a scissor device of conventional type for cutting the thread into lengths corresponding to "needlefuls", after the first two or three stitches have been sewn by the machine.

A length of thread sufficient for the sewing operation is unwound by the operator and laid into the open eye 5' of needle 5.

The sewing machine is started, and needle 5 is driven through the fabric 4, carrying the thread during its entire stroke; when the upstroke is started by the needle a loop is formed, which is engaged by the revolving disk 10.

The disk 10 disengages the thread from the eye 5' of needle 5, and the entire needleful (free thread length) is drawn below the fabric 4 by the rotary motion of same disk.

The needle 5 continues its upstroke without the thread, and comes out of the fabric 4, which is then advanced, thereby establishing the length of the stitch on the lower surface of the fabric.

At the end of the fabric advance, the needle starts its downstroke without thread, through the fabric 4 and, at the beginning of its upstroke, the thread which was retained below the fabric, is held by thread taker 12 across the path of the needle eye, being thereby carried through the fabric 4 and onto the top thereof.

At the end of needle upstroke, the fabric is advanced thereby establishing the length of stitch on the fabric top.

The next downstroke is then started by the needle, entraining the thread through the fabric 4, thus beginning a new sewing cycle.

The seam produced is shown in FIG. 9.

The sequence of operating steps of the several sewing devices, is shown in the diagrams of the accompanying drawings, as follows:

1. Start of sewing: the thread is inserted into the eye 5' of needle 5, which is located above fabric 4; all devices except the needle are inoperative, and are not engaged with the sewing thread.

In particular, the hook 18 of disk 10 is in a position nearly diametrally opposite to that of needle 5 (see FIGS. 3 and 4).

2. 1st cycle: (See FIGS. 10, 10A–11, 11A)

By the downstroke of needle 5, the thread is carried through the fabric 4; the disk 10, by turning through 180°, brings its hook 18 to a point at a distance of few degrees from the needle and the disk removes the thread from the open eye of the needle (compare FIG. 10A with FIG. 11).

The hook 13 and the thread tension 14 are advanced, thereby taking them out of engagement with the thread.

The needle 5 starts its upstroke motion, and now a loop is formed by the thread, which is no longer stretched on the needle. This loop is engaged by the hook 18 of disk 10 which, by its revolving motion, has brought said hook coincident substantially with the needle axis.

The upstroke of needle 5 is completed without thread; the hook 13 and the thread taker 14 are moved back thereby seizing the thread, while the disk 10 keeps on turning through further 180° pulling the thread below the fabric 4 over its entire free length. This length is laid into the groove 20 of stationary disk 21 (see FIG. 4).

After the upstroke, without thread, of needle 5, the fabric 4 is advanced by the feed-dog 21, thereby establishing the length of stitch on the lower fabric side.

3. 2nd cycle (see FIGS. 12–12A, and 13–13A).

After the feed of fabric, the needle has a downstroke without thread, while the swinging hook 6 is turned forwardly, and the thread taker 12 is advanced, thereby bringing the thread in front of the eye of needle 5. The disk 10 is rotated through 180°, thus bringing the hook 18 to its upper position, on the side of needle 5.

At the beginning of upstroke of needle 5, the thread is engaged by the needle eye and brought above fabric 4; the upstroke of needle 5 is completed, while the thread taker is brought back into its starting position and the disk 10 is turned by a further 180°.

The needle 5 is slightly lowered, to loosen the recovered thread, by which a loop is formed. The hook 6 engages the loop while turning back to its starting position.

The fabric 4 is advanced by the feed-dog 21, thus establishing the length of stitch on the upper fabric side.

The above stated cycles are continued in the same sequence, with the only difference, relative to the first cycle, the drawing of thread upwardly is performed with the aid of oscillating hook 6, i.e. hook 6 performs the function of aiding the drawing of the thread above the fabric.

(a) The hook 6 performs a guide function while the disk 10 pulls the thread loop which is formed below the fabric as can be seen in FIG. 11. The guide element or hook 6 thus prevents the free stretch of the "needleful" for tightening itself around the fabric during the formation of the upper stitch and during its transfer below the fabric by disk 10.

Such function is evident from FIG. 14A in which the entire course travelled by the free stretch of the "needleful" during the grasping operation carried out by disk 10 is illustrated.

A further function of hook 6 of maintaining of the thread alongside the needle during the advancementof the fabric for the formation of the upper stitch considering the fact that the needle's eye is open.

When the loop is formed above the fabric (FIGS. 13 and 13A), the hook 6 engages this loop and draws out the full free length of the thread remaining after the prior stitch formation. As a consequence, the loop is destroyed when the free end of the thread is withdrawn through the fabric.

(b) The hook 18 merely picks the thread out of the eye in stretching out the loop formed below the stitch plate as the disk rotates. The hook 18 rotates in the counterclockwise sense in FIG. 10A and entrains the thread through a lateral opening of the eye in this direction.

(c) The needle middle line is the needle axis and the position in which the hook is substantially in line with the needle axis shown in FIG. 10A.

(d) A "needleful" is thus a predetermined length of thread as described in the specification and the stitch seam shown in FIG. 9 has been variously identified as a saddle stitch, or short-long stitching, the latter designation being used when the upper stitch length if different from the lower stitch length.

(e) The scissor device can be a manually operated scissor although automatic thread cutters are conventional in the sewing machine art and may be used as well.

What I claim is:

1. A method of forming a stitched seam in a fabric with stitches lying alternately on opposite sides of the fabric, said method comprising the steps of:

(a) forming a length of thread above said fabric;

(b) engaging said length of thread in a laterally open eye of a needle and entraining a loop of said thread downwardly through said fabric to carry said loops below said fabric;

(c) releasing said thread from said eye and engaging said loop in a rotating hook disposed below said fabric to draw the free length of said thread downwardly through said fabric while raising said needle through said fabric;

(d) retaining the free length of thread below said fabric in a position enabling same to be engaged by a subsequent upward movement of said needle through said fabric, and passing said needle downwardly and upwardly through said fabric with said needle engaging the positioned thread length to draw a loop thereof upwardly through said fabric to the upper surface thereof;

(e) swinging an oscillating hook into engagement with said loop above the upper surface of said fabric to guide the remaining free length of thread therethrough to prevent the thread from tightening itself around the fabric and maintaining it alongside the needle;

(f) advancing said fabric each time said needle is withdrawn upwardly from said fabric to form alternate stitches on opposite sides thereof; and (g) repeating steps (a) through (f) to form said seam.

2. A sewing machine for stitching a seam in a fabric with stitches lying alternately on opposite sides of said fabric, said sewing maching comprising:

(a) support means provided with a stitch plate adapted to receive a fabric thereon and formed with feed means for the stepwise advance of said fabric passing a stitching location;

(b) an arm extending over said stitch plate and provided with a presser foot and retaining said fabric against said stitch plate at said location;

(c) a needle vertically reciprocatable on said arm at said location for passing downwardly and upwardly through said fabric, said needle having a laterally open eye of double-hook configuration;

(d) a disk rotatable below said stitch plate and formed with a hook engageable with a loop of a free length of thread entrained downwardly through said fabric for disengagement of said thread from said eye and drawing out said length of thread below said fabric;

(e) a thread taker disposed below said stitch plate and engageable with the drawn out length of thread for holding same in a position for engagement in said eye upon a subsequent upstroke of said needle whereby said needle entrains a loop of said thread upwardly through said fabric;

(f) a hook pivotally mounted on said arm engageable with the loop entrained above said fabric by said needle for guiding the remaining free length of thread through said fabric and onto the upper surface thereof while maintaining the thread against the needle; and (g) drive means for synchronously displacing said needle, said feed means, said disk, said thread taker and said hook.

3. The sewing machine defined in claim 2 wherein said disk is rotatable in a plane parallel to the plane of said needle about a horizontal axis, the disk plane being offset from the plane of said needle.

4. The sewing machine defined in claim 3, further comprising another hook disposed beneath said stitch plate and engageable with the thread entrained by said needle therebelow and drawn out by said disk.

5. The sewing machine defined in claim 4, further comprising a thread tension member adapted to clamp the free length of thread beneath said stitch plate, said thread tension member and said other hook being horizontally shiftable beneath said stitch plate.

6. The sewing machine defined in claim 5 wherein said taker is a fork-shaped member reciprocatable horizontally and adapted to straddle said needle 7. The sewing machine defined in claim 6, further comprising a stationary disk formed with a circumferential groove and receiving said free length of thread below said stitch plate.

* * * * *